United States Patent [19]

Trudel

[11] 4,375,954

[45] Mar. 8, 1983

[54] OIL AND GAS COMBINATION NOZZLE

[76] Inventor: Roger Trudel, 1616 First Ave., Val Caron, Ontario, Canada, P0M 3A0

[21] Appl. No.: 107,277

[22] Filed: Dec. 26, 1979

[51] Int. Cl.[3] ..... F23M 3/00; F23D 11/44

[52] U.S. Cl. ..... 431/9; 431/11; 431/243; 431/284; 431/285; 239/419.3; 239/427.5

[58] Field of Search ..... 431/9, 10, 11, 161, 431/185, 187, 189, 242, 243, 351, 352, 284, 285; 239/8, 13, 135, 419.3, 406, 424.5, 427.5

[56] References Cited

U.S. PATENT DOCUMENTS

| | | | |
|---|---|---|---|
| 2,210,403 | 8/1940 | Skinner | 239/419.3 X |
| 2,931,324 | 4/1960 | Wallis et al. | 431/285 X |
| 2,992,531 | 7/1961 | Hershey | 431/284 X |
| 3,483,700 | 12/1969 | Ryberg | 431/187 X |
| 3,529,915 | 9/1970 | Tsuji et al. | 431/284 |
| 3,897,200 | 7/1975 | Childree | 431/285 X |
| 4,094,625 | 6/1978 | Wang et al. | 431/9 |

*Primary Examiner*—Samuel Scott
*Assistant Examiner*—Randall L. Green
*Attorney, Agent, or Firm*—W. Irwin Haskett

[57] ABSTRACT

There is provided an improved combination oil and gas nozzle comprising a housing, a forward portion of which includes an enclosed chamber adjacent at least a part of a combustion zone, a gas inlet into said housing leading to a mixing chamber within said housing, an air inlet into said housing leading to said mixing chamber, a series of passages leading from said mixing chamber to a rearward portion of said combustion zone, an oil lance and nozzle extending through the rear portion of said housing and extending essentially centrally into said combustion zone downstream of the outlet of said series of passages, an oil inlet to said essentially annular chamber and an oil passage from said chamber to said oil nozzle. There is further provided a method of utilizing oil and gas in combination in such a nozzle.

19 Claims, 3 Drawing Figures

OIL AND GAS COMBINATION NOZZLE

BACKGROUND OF THE INVENTION

This application relates to a combination oil and gas nozzle.

With rapidly increasing energy costs there is a constant need to improve the efficiency of energy consuming devices. One such device is the oil and/or gas nozzle which finds widespread application in both residential and industrial locations. Examples of these locations are furnaces and water heaters in the home, and boilers in industry. Conventional heating units are generally of low efficiency, in the order of 60 to 70% heat recovery.

The present invention is directed toward a nozzle of increased efficiency.

Because of the widespread use of these nozzles, there are a great many such devices in the prior art, differing from each other in various details. Each represents a specific configuration of the various parameters which are of concern in nozzle design. In some cases a specific feature of the design is relied upon as offering new and valuable advantages. In other cases overall nozzle design provides advantages. Furthermore, the improvements in nozzle design for one application are often inappropriate for another, as a result of different emphasis placed on various of the design parameters.

As suggested above, the basic requirement that a nozzle be energy efficient has not generally in the past been a major consideration in itself in nozzle design. As a result, heat recovery has generally been, as indicated, in the order of 60 to 70%.

BRIEF SUMMARY OF THE INVENTION

It is an object of this invention to provide an oil and gas combination nozzle providing improved efficiency of heat recovery from fuel through the use of a nozzle wherein the oil feed is preheated within the nozzle itself, and wherein gas feed is premixed with combustion air within the nozzle itself. There is also some preheating of the combustion air for the oil.

Accordingly, the invention provides a combination oil and gas nozzle comprising a housing, a forward portion of which includes an enclosed chamber adjacent at least a part of a combustion zone, a gas inlet into said housing leading to a mixing chamber within said housing, an air inlet into said housing leading to said mixing chamber, a series of passages leading from said mixing chamber to a rearward portion of said combustion zone, an oil lance and nozzle extending through the rear portion of said housing and extending essentially centrally into said combustion zone downstream of the outlet of said series of passages, an oil inlet to said essentially annular chamber and an oil passage from said chamber to said oil nozzle.

There is further provided a method of utilizing oil and gas in a combustion nozzle comprising premixing with a gaseous fuel inlet stream sufficient air to support complete combustion of both the gas and oil feeds, feeding said mixture into a rearward portion of the combustion zone of said nozzle through an annular series of passages, said passages being sloped or curved to impart a spiralling effect to the mixture in the said combustion zone, preheating the oil feed to the nozzle by passing said feed through a heat exchange chamber in the nozzle housing adjacent at least a part of said combustion zone, and directing said preheated oil into said combustion zone through an essentially central oil nozzle extending into said combustion chamber downstream of the point of entry of said gaseous feed mixture.

BRIEF DESCRIPTION OF THE DRAWINGS

Preferred embodiments of the invention are illustrated in the following Figures.

DETAILED DESCRIPTION

Figure 1:
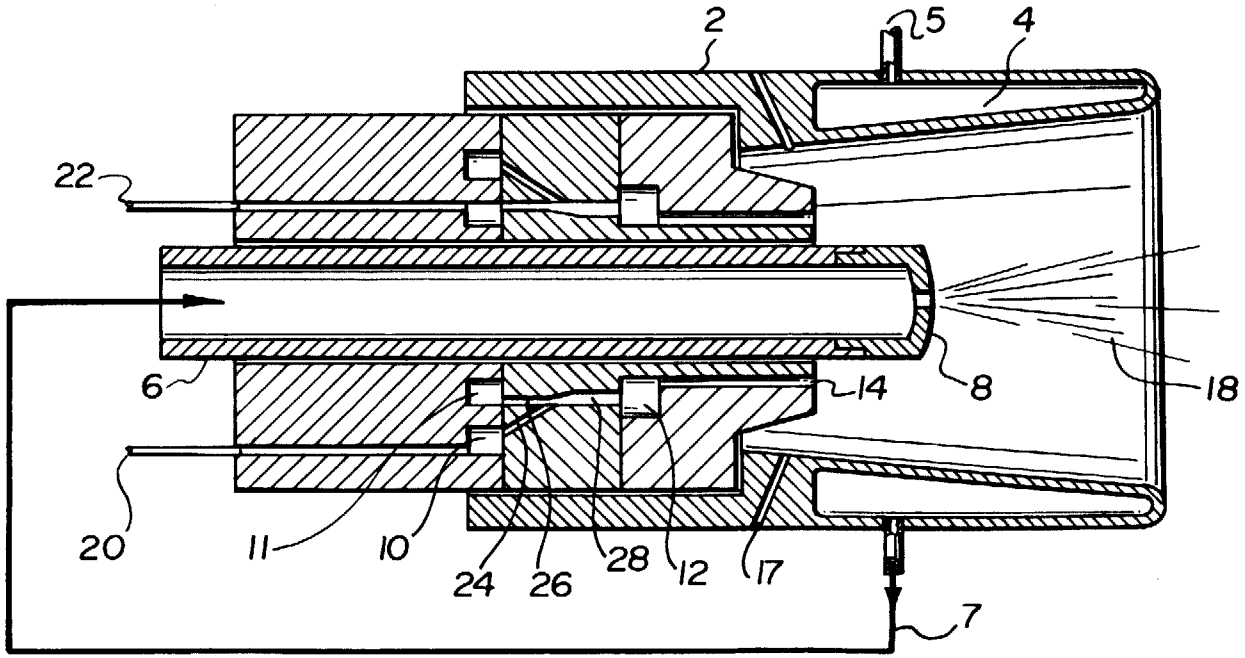
FIG. 1 is a cross-sectional schematic, taken longitudinally, of a nozzle according to the invention.

With reference to the drawings, in an overview view the burner comprises a housing 2, oil pre-heating chamber 4, a conventional oil lance 6 and nozzle 8 located centrally in the housing 2, annular gas chamber 10 and air chamber 11, annular air/gas mixing chamber 12, and air/gas outlets 14 to the combustion chamber. The housing 2 also preferably includes a series of subsidiary air passages 17 arranged around the combustion zone.

As is the case in many conventional nozzles, the housing 2 toward its forward end defines an essentially frusto-conical combustion zone 18. In the present case at least a part of that forward portion is hollow and contains oil pre-heating chamber 4, preferably annular in configuration and encircling the combustion zone 18. In operation oil from a supply is fed via oil inlet 5 into the pre-heating chamber 4 and is heated by the heat from the combustion zone.

The preheated oil is then directed via passage 7 to the oil lance 6 and hence through the nozzle 8 to the combustion zone. In a preferred embodiment the oil lance is adjustable as shown by threaded connection at 9 in FIG. 2 to protrude to a greater or lesser extent into the combustion zone 18 to control the size and shape of the flame. The lance 6 and the nozzle 8 are both of conventional design well known to those skilled in the art, and, accordingly, a variety of such designs are suitable in the present case.

Gaseous fuel for the nozzle is fed into the rearward section of housing 2 through gas inlet 20 to the air/gas mixing chamber 12. Inlet 20 may be arranged to impart a spiralling effect to the gas entering chamber 12. Similarly, combustion air is fed into the rearward section of housing 2 through air inlet 22 to the air/gas mixing chamber 12. Inlet 22 may be arranged to impart a spiralling effect to the air entering chamber 12.

Alternatively, and in the preferred configuration, a gas chamber 10 and an air chamber 11 may be imposed between the gas and air inlets respectively and the air/gas mixing chamber 12.

In that case, leading from gas chamber 10 and air chamber 11 are a series of passages 24 and 26 respectively. These passages preferably come together to form a corresponding series of common passages 28 leading to mixing chamber 12. In all cases the passages are preferably inclined or curved to impart a spiralling effect to the air and gas to promote mixing in the passages 28 and in the chamber 12.

Figure 2:
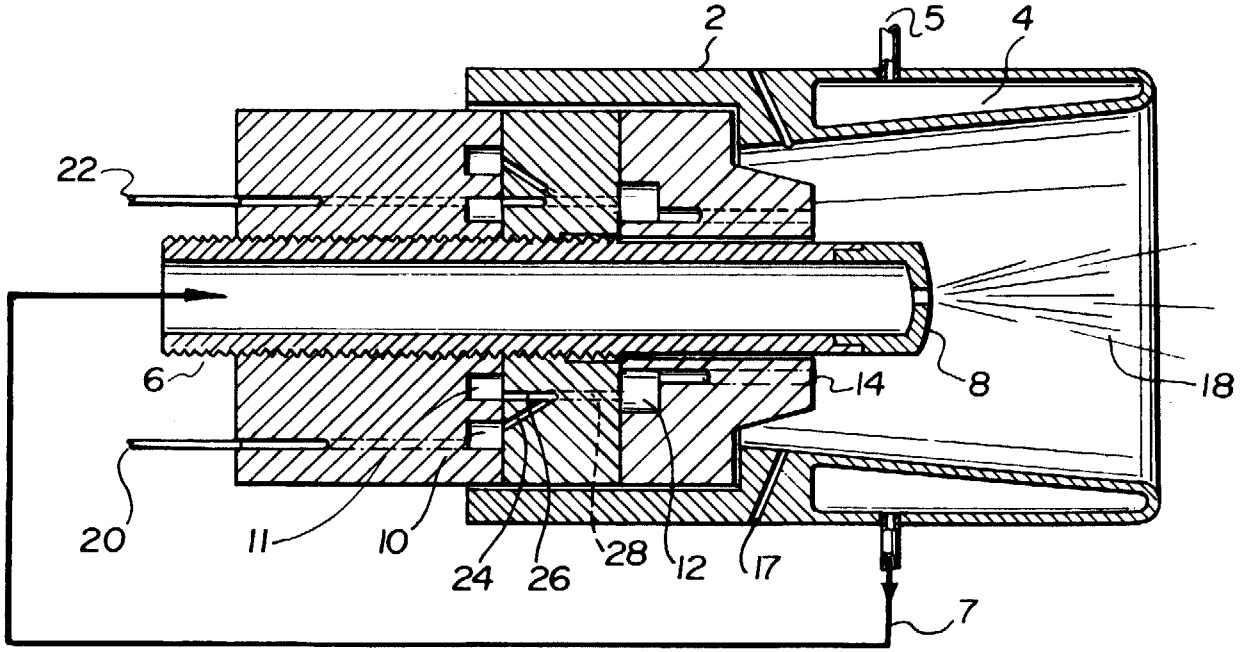
FIG. 2 is a cross-section similar to FIG. 1 but showing additional embodiments of the invention.
Figure 3:
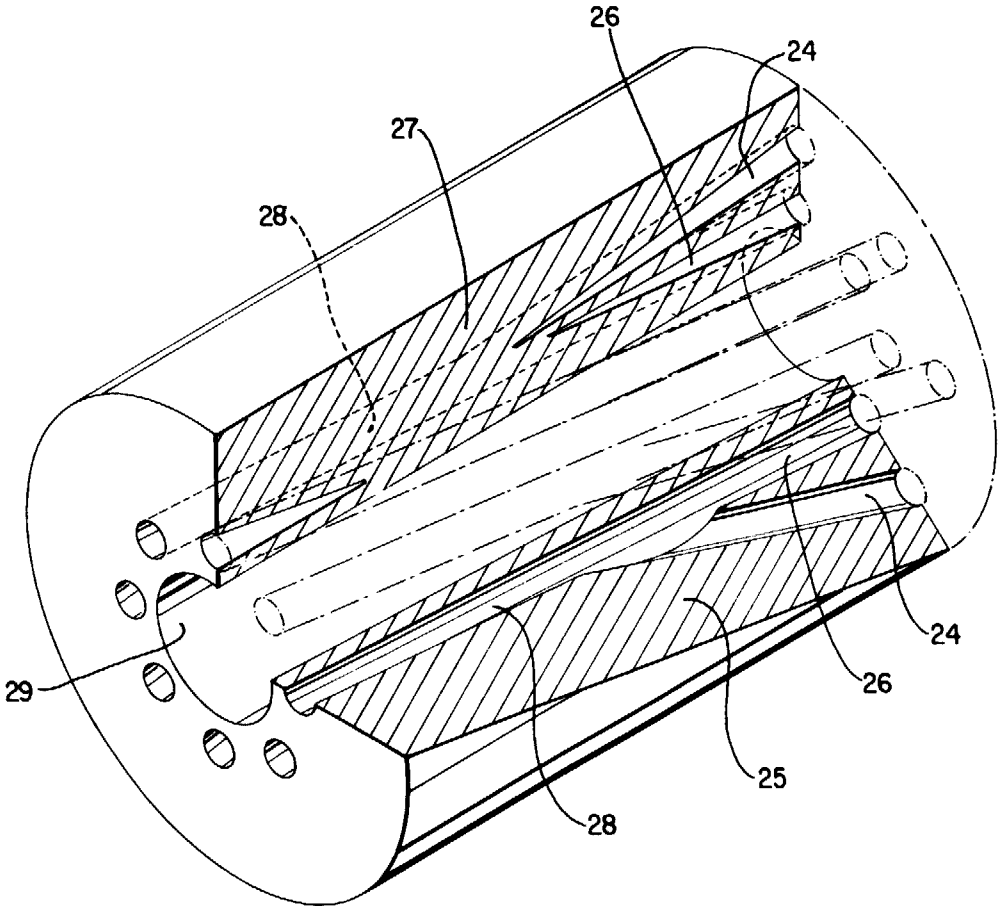
FIG. 3 shows detail of a portion of the nozzle of FIG. 2.

These sloped passages are illustrated in FIGS. 2 and 3. FIG. 3 has been drawn to particularly illustrate the nature of one embodiment of the slope of passages 24 and 26. Thus the sectional plane 25 is drawn longitudinally of the nozzle and plane 27 is drawn with an additional angular component in the section to follow the plane of the passages. The chain lines illustrate parts of passages in front of the illustrated sections. The passages 20 and 22 and the series 14 can be sloped in a similar manner.

The gas feed to the unit is, as in the conventional case, under pressure. The incoming air by way of inlet 22 is also under a positive pressure and the air source preferably supplies compressed air.

From mixing chamber 12 the gaseous fuel mixture is fed through a series of passages 14 to the combustion zone. The passages are preferably inclined or curved to impart a spiralling motion to the gaseous fuel mixture in the combustion zone. The series of passages preferably terminates in a circular series of outlets arranged around the oil nozzle.

Additional combustion air is drawn into the combustion chamber through passages 17. This is accomplished by the aspirator effect of the initial air/gas mixture or the flaming mixture rushing by passages 17.

The spiralling motion of the gaseous mixture promotes faster and more complete burning of the liquid fuel by promoting mixing of combustion air with the liquid fuel and by ensuring that no liquid fuel can escape between incoming gas streams. This is accomplished essentially by reason of the spiralling flames from the gaseous fuel enveloping the oil spray in the combustion zone.

In operation the gaseous fuel ignites upstream of the oil nozzle. The excess air in the mixture, over and above that required for combustion of the gaseous fuel, is heated by combustion of that fuel. This heated air then becomes the combustion air for combustion of the oil. Consequently, both the air and the oil are pre-heated prior to combustion of the oil. This results in a very quick and complete burning of the liquid fuel, resulting in a very efficient heat recovery.

The components of the combustion mixture can vary over a wide range with respect to both their specific identity and their relative proportions. This factor permits the basic invention to be tailored to the needs of a wide range of specific applications. It permits the optimizing of various design considerations in both the technical and economic sense. Such considerations include in the economic sense the cost and availability of the liquid and gas fuels and in the technical sense the size and temperature of the desired flame.

Thus the gaseous fuel may be, for example, propane or natural gas. Many other gaseous fuels would be suitable depending on the requirements of the job. In a preferred embodiment for general usage, the gaseous fuel comprises a proportion of 10 to 25% of total fuel based on total heating value. Clearly, however, the liquid and gaseous fuels can be combined in any desired proportion.

The combustion air requirement is simply that there be sufficient air to allow complete combustion in order to take advantage of the efficiency of the device.

As an example of one embodiment, the liquid fuel may be fuel oil. The conventional oil nozzle may typically have a heating value rating of 100,000 to 2,000,000 BTU/hr or an oil flow rating of 0.5 to 10 gal./hr. The nozzle can be adapted to higher ratings. The shape of the oil flame in the combustion zone can be altered as desired by extending or retracting the nozzle 8 by means of the adjustable lance 6.

A measure of flame control can also be obtained by the use of compressed air as the combustion air feed. The compression combined with the preheating results in a short intense flame in the liquid fuel combustion. This results in a reduction of the required combustion area and in higher heat transfer rates.

The fast intense burning yields a more complete burn with reduction of polutants in the stack gases.

EXAMPLE 1

A test was conducted to measure the efficiency of the unit. A heat exchanger apparatus was set up and required measurements taken. The following heat balance illustrates the result:

| HEAT INPUT | | | |
|---|---|---|---|
| A. | OIL | Flow rate 0.425 Gal./Hr. | |
| | | Available heat 170,000 Btu/Gal. | 72,000 |
| | | Heat input 0.425 × 170,000 | Btu/Hr. |
| B. | GAS (PROPANE) | Flow rate 1.25 Lbs/Hr. | |
| | | Available heat 21,500 Btu/Lb. | 27,000 |
| | | Heat input 1.25 × 21,500 | Btu/Hr. |
| | | TOTAL HEAT INPUT | 99,000 Btu/Hr. |

| HEAT OUTPUT | | | |
|---|---|---|---|
| A. | WATER | Flow rate 90 Gal/Hr. | |
| | | Temperature increase 105 F.° | |
| | | Specific heat 1 Btu/Lb F.° | |
| | | Density 10 Lb/Gal. | 94,500 |
| | | Heat output (90 × 10 × 105 × 1) | Btu/Hr. |
| B. | STACK GAS | Flow rate 1050 SCFH | |
| | | Temperature increase 60 F.° | |
| | | Specific heat 0.20 Btu/Lb | |
| | | Density 1/13.3 Lb/SCF | 1,000 |
| | | Heat output (1050/13.3) × 0.20 × 60 | Btu/Hr. |
| C. | OUTER SURFACE OF EXHANGER | Area 800 Sq. In. | |
| | | Surface temp. 170° F. | |
| | | Heat Transfer Coefficient 0.019 | |
| | | Ambient Air 70° F. | 1,500 |
| | | Heat output, (0.019 × 800 × 100) | Btu/Hr. |
| | | TOTAL HEAT OUTPUT | 97,000 Btu/Hr. |

While the invention has been described in detail in respect of the preferred embodiments, it will be understood that it is not intended to limit the invention to those embodiments. On the contrary it is intended to cover all alternatives, modifications and equivalents as may be included within the spirit and scope of the present invention.

What I claim as my invention:

1. A combination oil and gas nozzle comprising
   - a housing, a forward portion of which includes an enclosed annular chamber adjacent at least a part of a combustion zone,
   - a gas inlet into said housing leading to a mixing chamber within said housing,
   - an air inlet into said housing leading to said mixing chamber,
   - a series of passages leading from said mixing chamber to a rearward portion of said combustion zone,
   - an oil lance and nozzle extending through the rear portion of said housing and extending essentially centrally into said combustion zone downstream of the outlet of said series of passages,
   - an oil inlet to said essentially annular chamber, and
   - an oil passage from said chamber to said oil lance and nozzle.

2. The combustion nozzle of claim 1 wherein said enclosed chamber is essentially annular in configuration encircling at least a part of said combustion zone.

3. The combination nozzle of claim 1 wherein said series of passages terminates in an essentially circular pattern of outlets arranged around said oil nozzle.

4. The combination nozzle of claim 1 wherein said series of passages is curved or sloped to impart a spiralling effect to the air and gas mixture in the combustion zone.

5. The combination nozzle of claim 1 including within the nozzle housing at least one of an annular air chamber and an annular gas chamber located between the respective air and gas inlets and said mixing chamber.

6. The combination nozzle of claim 1 including an annular air chamber and annular gas chamber located within the nozzle housing between the respective air and gas inlets and said mixing chamber, and a series of passages leading from each of said chambers, each of said passages from said air chamber meeting a corresponding one of said passages from said gas chamber to form a series of common air and gas passages leading to said mixing chamber.

7. The combination nozzle of claim 6 wherein at least said common series of passages is curved or sloped to impart a tangential component of velocity to the air and gas mixture in said mixing chamber.

8. The combination nozzle of claim 7 wherein both said series of passages and said series of common passages are so sloped or curved.

9. The combination nozzle of claim 1 wherein the combustion zone is generally of frusto-conical configuration.

10. The combination nozzle of claim 1 wherein at least one of the air and gas inlets is curved or sloped to impart a spiralling effect to the respective incoming stream.

11. The combination nozzle of claim 1 wherein the oil nozzle includes an adjustable oil lance whereby the amount of extension of the oil nozzle into the combustion chamber may be adjusted.

12. The combination nozzle of claim 1 including, in addition, a series of supplementary air inlets through said housing and entering the combustion zone upstream of the outlets of said series of passages.

13. The combination nozzle of claim 12 wherein said supplementary air inlets are arranged in an essentially circular pattern around said housing.

14. In a combination oil and gas burning nozzle including a nozzle housing and a combustion zone defined by said housing, a method of utilizing both oil and gas fuels in said nozzle comprising:

directing said gas through at least one gas inlet passage to a mixing chamber in said housing;

directing at least a major portion of the air required to support complete combustion in said nozzle through at least one air inlet passage to said mixing chamber whereby to premix said air and gas feeds;

feeding said mixture into a rearward portion of the combustion zone of said nozzle through an annular series of passages, said passages being sloped or curved to impart a spiralling effect to the mixture in the said combustion zone;

allowing additional air to be drawn into the combustion zone, through a series of passages in said housing;

preheating the oil feed to the nozzle by passing said feed through a heat exchange chamber in the nozzle housing adjacent at least a part of said combustion zone; and directing said preheated oil into said combustion zone through an essentially central oil nozzle extending into said combustion zone downstream of the point of entry of said gaseous feed mixture.

15. The method of claim 14 including preheating the oil feed to the nozzle by passing said feed through an annular heat exchange chamber in said housing adjacent said combustion zone.

16. The method of claim 14 wherein at least a part of said major portion of the air is compressed air.

17. The method of claim 16 wherein said compressed air is at about 40 psi.

18. The method of claim 14 wherein said premixing is carried out in an annular mixing chamber in the nozzle housing and wherein said series of passages extend from said mixing chamber to said combustion zone.

19. A combination oil and gas nozzle comprising:

a housing, a forward portion of which includes an enclosed essentially annular chamber encircling a combustion zone, a gas inlet into said housing leading to an annular gas chamber within said housing an air inlet into said housing leading to an annular air chamber within said housing, a series of sloped passages leading from each of said gas and air chambers, each of said passages from said air chamber meeting a corresponding one of said passages from said gas chamber to form a first series of common air and gas passages leading to a mixing chamber within the nozzle housing, a second series of sloped passages leading from said mixing chamber to form a circular pattern of outlets into the rearward portion of the combustion zone, an oil lance and nozzle extending through the rear portion of said housing and extending essentially centrally into said combustion zone downstream of the outlet of said second series of passages, an oil inlet to said essentially annular chamber, and an oil passage from said chamber to said oil lance and nozzle.

* * * * *